US007293751B2

(12) United States Patent
Eriksson

(10) Patent No.: US 7,293,751 B2
(45) Date of Patent: Nov. 13, 2007

(54) ADJUSTABLE SUPPORT FOR LAP WORK

(76) Inventor: Bo Goran Eriksson, 26 Revere Cir., Washingtonville, NY (US) 10992

( * ) Notice: Subject to any disclaimer, the term of this patent is extended or adjusted under 35 U.S.C. 154(b) by 276 days.

(21) Appl. No.: 11/078,963

(22) Filed: Mar. 14, 2005

(65) Prior Publication Data

US 2005/0264992 A1 Dec. 1, 2005

Related U.S. Application Data

(60) Provisional application No. 60/574,151, filed on May 26, 2004.

(51) Int. Cl.
*B65D 19/00* (2006.01)

(52) U.S. Cl. ..... 248/346.01; 108/43; 248/918; 411/389; 411/546

(58) Field of Classification Search ..... 248/346.01, 248/346.02, 346.03, 346.06, 918; 211/59.4; 411/546, 389; 108/43, 115
See application file for complete search history.

(56) References Cited

U.S. PATENT DOCUMENTS 6,003,446 A * 12/1999 Leibowitz ..... 108/43
6,044,758 A * 4/2000 Drake ..... 100/43
6,076,787 A * 6/2000 Troyer ..... 248/166
6,173,656 B1 * 1/2001 Blanchard ..... 108/43
6,474,614 B2 * 11/2002 MacEachern ..... 248/349.1
6,659,702 B2 * 12/2003 Kitayama et al. ..... 411/546
6,675,721 B2 * 1/2004 Zeiders ..... 108/43
6,682,040 B1 1/2004 MacEachern
6,773,060 B2 * 8/2004 Sher et al. ..... 297/188.14
6,880,787 B2 * 4/2005 Stephen et al. ..... 248/68.1
7,137,767 B2 * 11/2006 Franke et al. ..... 411/401
2005/0053449 A1 * 3/2005 Grubert et al ..... 411/546

FOREIGN PATENT DOCUMENTS

DE 20314003 U * 12/2003

* cited by examiner

*Primary Examiner*—Ramon O Ramirez
(74) *Attorney, Agent, or Firm*—Joseph B. Taphorn

(57) ABSTRACT

An adjustable support for a portable computer or the like having a main or center board, side boards, and cylindrical stackers interconnecting them. The device is designed to hold a portable computer on the main board and to dispose it weightlessly in the lap area of a seated user by means of the side boards resting on the arms of the easy chair, or couch or sofa on which the user is seated. The distance between the side boards and the main board of the device may be varied by changing the number of stackers each of which have mating male and female ends to enable interconnecting them. The main board and the sideboards may have through-holes of two different diameters each: a larger one for receiving and rendering flush the head of a nut or bolt cooperating with a respective stacker end to secure the stacker rigidly to the board; a smaller one for snugly receiving reduced portion of the nut or bolt. The larger diameter portions of the through-holes only penetrate halfway through the boards. The female ends of the stackers are threaded openings which will receive the threaded bosses constituting the male ends of other stackers for interconnection end to end or the threaded ends of bolts to secure the stackers to boards. The nuts beyond their heads are each formed with a sleeve snugly received in the reduced diameter of through-holes and mating with threaded boss on the end of a stacker.

13 Claims, 10 Drawing Sheets

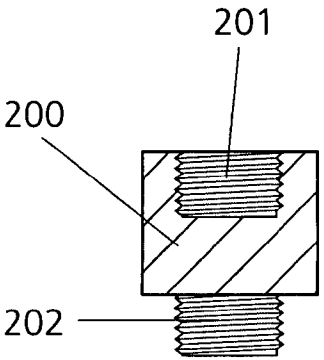
Fig. 7A
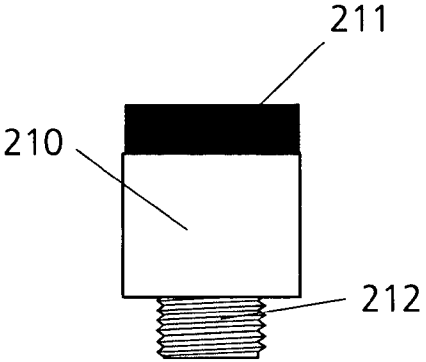
Fig. 8A
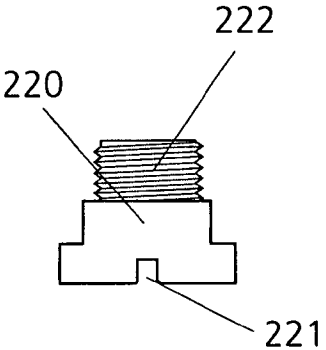
Fig. 9A
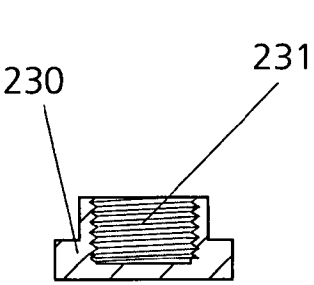
Fig. 10A
Fig. 7B
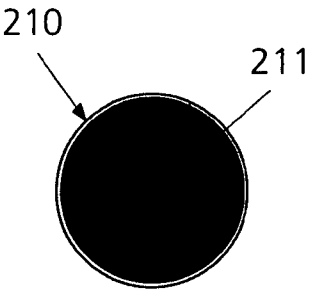
Fig. 8B
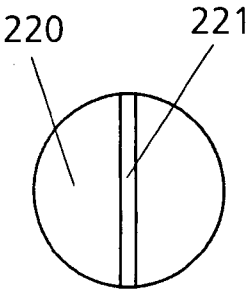
Fig. 9B
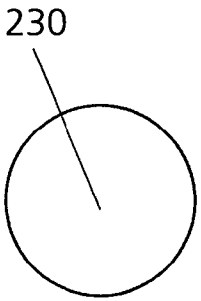
Fig. 10B

ADJUSTABLE SUPPORT FOR LAP WORK

PRIORITY

Applicant claims priority based on the filing of Invention Disclosure Document No. 60/574,151 on May 26, 2004 in the United States Patent and Trademark Office.

FIELD OF THE INVENTION

This invention relates to devices for conveniently supporting in a preferred position a tool such as a personal computer, a work such as a machine being assembled, or a game board; and more particularly to a device for quiescently supporting weightlessly in different environments the tool, work, or game board, in the lap of a person attending thereto.

1. Background of the Invention

Much activity takes place in a lap. A lap should be understood to be that area in front of a seated-person's body below the waist and above the thighs and knees, in which one may conveniently act on anything. Laptop computers are a prime example of a tool that one may conveniently operate in a lap indoors as well as outdoors for word processing, web-surfing, gaming, watching DVDs, and much more. Portable typewriters are another example of such a tool. It is desirable to have a tool such as a laptop or a typewriter usable anywhere on a stable, quiet platform at the right height, with no weight, pressure or heat transferred to the seated users legs.

2. Prior Art

The prior art includes the following U.S. patents:

| U.S. Pat. No. | Issued | Inventor | Disclosure |
|---|---|---|---|
| 382,687 | May 15, 1888 | Burlin | Child's high chair detachable table |
| 804,462 | Nov. 14, 1905 | Powell | Shiftable chair book holder or rest |
| 1,760,414 | May 27, 1930 | King | Child's high chair with adjustable tray |
| 2,478,280 | Aug. 09, 1949 | Kroll et al | Child's high chair table adjustable latch |
| 3,142,511 | Jul. 28, 1964 | Rehel | Wheel chair tiltable table |
| 4,946,120 | Aug. 07, 1990 | Hatcher | Support on a car seat |
| 5,074,620 | Dec. 24, 1991 | Jay et al | Wheel chair raisable and pitchable seat |
| 5,087,097 | Feb. 11, 1992 | Hehn | High chair detachable tray |
| 5,161,766 | Nov. 10, 1992 | Arima | Portable work station for user occupying available furniture |
| 5,437,367 | Aug. 01, 1995 | Martin | Carrying case for electronic components and having shelves |
| 5,590,607 | Jan. 07, 1997 | Hovard | Portable shelf with folding supports for notebook computers |
| 6,019,050 | Feb. 01, 2000 | Ranta | Portable and adjustable table with improved leg assembly |
| 6,021,535 | Feb. 08, 2000 | Baus et al | Computer ergonomic workstation for recumbent position |
| 6,021,720 | Feb. 08, 2000 | Boos et al | Stand for supporting and securing items such as a portable computer |
| 6,044,758 | Apr. 04, 2000 | Drake | Configurable and foldable lap desk |
| 6,045,179 | Apr. 04, 2000 | Harrison | Portable and adjustable keyboard stand for computer for arm chair |
| 6,105,508 | Aug. 22, 2004 | Ryburg | Work surface for luggage and luggage carriers |
| 6,234,085 | May 22, 2001 | Ramondo | Lap tray workstation |
| 6,260,486 | Jul. 17, 2001 | Boos et al | Stand with hinged leaf for supporting and securing items such as a portable computer |
| 6,353,530 | Mar. 05, 2002 | Zarek | Method for supporting a laptop computer base on user's lap |
| 6,382,745 | May 07, 2002 | Adkins | Laptop workstation with cabinet and swinging arm |
| 6,439,134 | Aug. 27, 2002 | Ryburg | Work surface and leg assembly for luggage and luggage carriers |
| 6,474,614 | Nov. 08, 2002 | MacEachern | Heat dissipating laptop computer stand with adjustable tilt |
| 6,496,360 | Dec. 17, 2002 | Cordes | Laptop portable computer desk with web strapping |
| 6,568,650 | May 27, 2003 | Helmetsie et al | Laptop accessory with louvers |
| 6,659,319 | Dec. 09, 2003 | Purpura | Laptop transport and support system in backpack for mobile environments |
| 6,663,072 | Dec. 16, 2003 | Ritchey et al | Lap stabilization device with leg strap |
| 6,672,557 | Jan. 06, 2004 | Jackson | Laptop computer support board with lamp |
| 6,682,040 | Jan. 27, 2004 | MacEachern | Heat dissipating laptop computer stand with adjustable tilt and risers |

The prior art includes the following Great Britain patent:

| | | | |
|---|---|---|---|
| 2,206,488 | Jan. 11, 1989 | Wilcox | Wheel chair easily removable tray |

The prior art includes the following U.S. patent applications

| | | | |
|---|---|---|---|
| 20020134697 | Sep. 26, 2002 | Barnett | Portable laptop workstation having shells |
| 20020178972 | Dec. 05, 2002 | McNeil | Laptop computer support table on luggage |
| 20030218113 | Nov. 27, 2003 | Sullivan | Universal laptop computer mount with hold-down member |

SUMMARY OF THE INVENTION

Accordingly, it is an object of the invention to provide a device for supporting an object at a convenient location in a seated user's lap area.

Another object of the invention is to provide such device a which is adjustable for the greater comfort of the user and ease of use.

A more specific object of the invention is to provide such a device that can be readily adjusted to a preferred position in the user's lap.

Still another object of the invention is to provide such a device which is stable, sturdy, durable, secure, and expandable.

Yet another object of the invention is to provide such a device that can be used in different environments.

A further object of the invention is to provide such a device which is simple of construction and easy of assemblage.

The objects of the invention are attained through the spatial inter-connection of three boards. A main or center board is rigidly connected at its ends in vertically spaced relation to the inner ends of two side boards. When used with an arm chair, the side boards might be placed on the chair arms, with the main or center board at a lower level to provide a working surface at a desired level. When working at one end of a sofa, the side board on the arm side of the sofa might be elevated to rest on the arm while the other side board might be depressed to rest on the sofa seat while supporting the center board in horizontal position. Of course, if one were seated in the middle of a couch, with no arms adjacent, both side boards might be depressed to rest on the couch and support the center board in spaced elevated relation thereto and in a preferred position in the lap area of a user.

A feature of the invention is that the vertical distances between the man board and the side boards can be adjusted. To this end, the boards are rigidly interconnected by the number of stackers necessary to achieve the spacing providing the preferred position of the user. A plurality of readily inter-connectable stackers are provided a would-be user to enable assemblage of the device into various spacings.

The stackers are elongated devices having matching male and female ends, and preferably shoulders for rigidly engaging the boards and/or each other to form a set. The male and female ends are complementarily threaded so that the male end of one stacker is matingly received in the female end of the other, and preferably so that the respective shoulders engage.

The stackers may be cylindrical devices having a main body of one diameter, and a threaded boss of reduced diameter. The other end has a threaded opening for receiving the threaded boss of another stacker. Through-holes in the ends of the boards receive the reduced-diameter threaded bosses of the stackers; the shoulders of the stacker main body make for rigidity of the device when the stacker end is fully secured onto a board through-hole or a stacker opening.

The stackers rigidly engage the boards via through-holes. The male end of a stacker or set of stackers is received within the through-holes. The male end is of a length as not to extend through the through-hole beyond the surface of the board. The through-hole need not threaded but sufficiently larger in diameter than a threaded boss or male end to slidably receive snugly the open end of a complementarily threaded sleeve of a flat-top connector or headed female stacker or nut formed with an enlarged flange of sufficient diameter not to pass completely through a board through-hole.

The female end of a stacker or set of stackers is of a diameter not to be received in a through-hole. It is secured to the surface of a board via a slot top connector or headed male stacker or bolt formed with a rod or pin having a complementarily threaded portion that may be matingly received in the female end of the stacker or set of stackers. The bolt rod or pin has an enlarged portion that is slidably received snugly in a board through-holes to where shoulders on the flange or head of the bolt engage the surface of the board when fully threaded in a stacker female end.

Additional through-holes are provided on the main board. In addition to allowing additional freedom in the way the boards are assembled, they facilitate computer cooling by serving as ventilation holes.

Some computers when used heavily, may require additional cooling. Conveniently, two or more of the main-board through-holes may be used to mount stackers with rubber tops to support a computer's rear end in spaced relation to the board, facilitating further cooling air circulation.

The rubber-topped stackers may also be used for ergonomic purposes. Thus a further and ergonomic advantage of the computer rear end stacking feature is that the computer keyboard and/or its screen may be presented to the user on a slope or cant that best suits him or her.

BRIEF DESCRIPTION OF DRAWINGS OF PREFERRED EMBODIMENT

These and other objects, features, and advantages of the invention will become apparent from a reading of the following description of preferred embodiments of the invention, especially when considered with the accompanying drawings wherein:

FIG. 7A is a side cross-sectional view of a vertical stacker employed in the adjustable support device of FIG. 1;

FIG. 7B is a top view of the stacker shown in FIG. 7A;

FIG. 8A is a side view of the rubber-topped stacker employed in the adjustable support device of FIG. 1 to raise the rear end of a computer for better ergonomics and/or cooling;

FIG. 8B is a top view of the rubber-topped stacker of FIG. 8A;

FIG. 9A is a side view of a threaded male end-stacker or slot top connector or bolt for connecting the female end of a stacker or set of stackers to a board;

FIG. 9B is a bottom view of the end-stacker of FIG. 9A;

FIG. 10A is a side cross-sectional view of a threaded female end-end stacker for connecting the male end of a stacker or set of stackers to a board;

FIG. 10B is a bottom view of the end-stacker of FIG. 10A;

DETAILED DESCRIPTION OF THE PREFERRED EMBODIMENT

Figure 1:
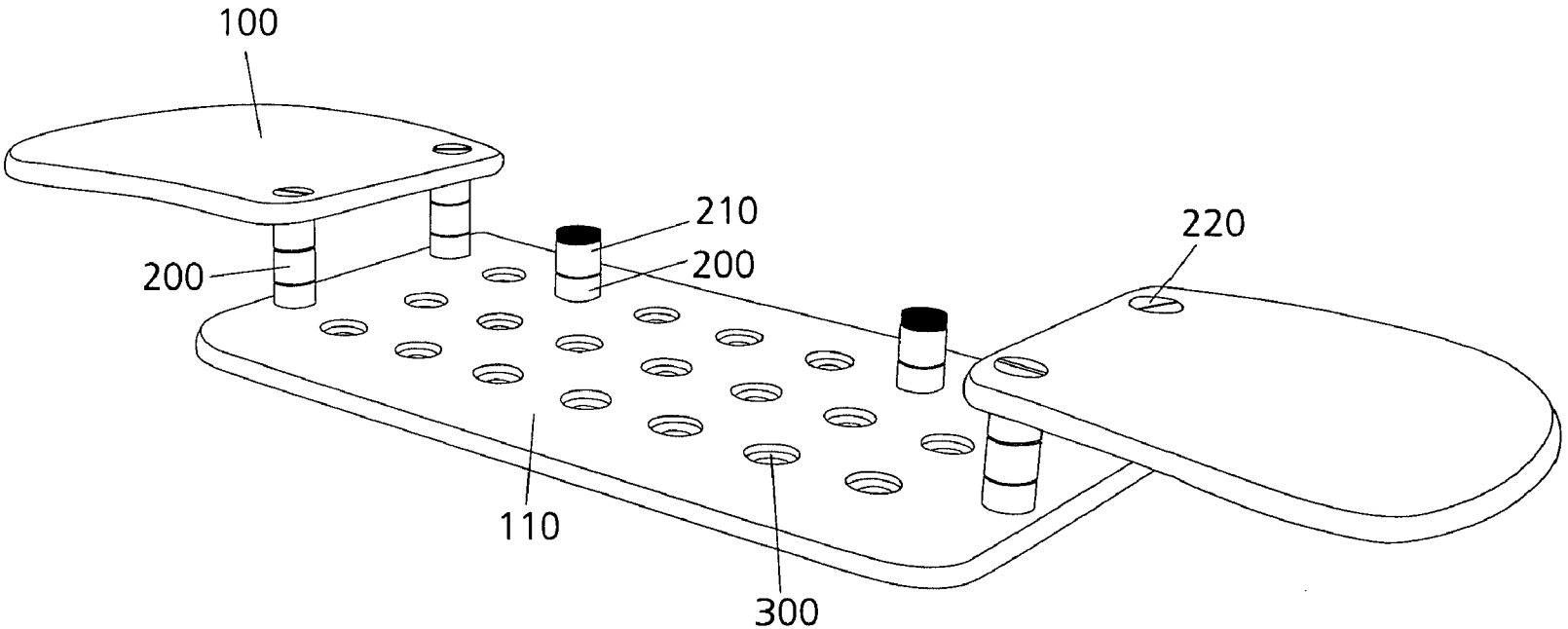
FIG. 1 is a perspective view of a adjustable support device particularly adapted for a portable personal computer.

Referring now more particularly to the drawings, there is illustrated in FIGS. 1 to 4 an adjustable support according to the invention. The support generally is comprised of one main or center board 110 and two, left and right, sideboards 100. The main board 110 is to hold an object such as a computer; the sideboards 110 are to rest on the arms of a chair to hold the device, and the object placed thereon, suspended between the chair arms. The main board 110 and two sideboards 100 are connected to each other with stackers 200.

The stackers 200 (FIGS. 7A and 7B) can be joined to each other to make longer stacks. The stackers 220 (FIGS. 9A and 9B) are used to connect the female ends of stackers 200 to the main board 200 and the sideboards 100. The stackers 230 (FIGS. 10A and 10B) are used to connect the male ends of stackers 200 to the main board 200 and the sideboards 100. The combined height of the stackers 200 determines the distance between the main board 110 and the sideboards 100 and can be adjusted to suit the user's convenience by adding or subtracting the stackers 200. The stackers 210 (FIGS. 8A and 8B) have a top of suitably-secured rubber to rest an object softly and frictionally in elevated position The main board 110 and side boards 100 have through-holes 300 to mount the stackers 200, 210, 220, and 230, and other attachments. The through-holes 300 are all of the same dimension and may have two different diameters: a smaller diameter portion that receives the threaded end of a stacker 200 or 220 and/or either the enlarged portion of the rod or pin of a male end-stacker or the sleeve of a female end-stacker; and a second bigger diameter that penetrates only partially though a board either on one or both sides of the board. The partially penetrating or larger diameter portion of a hole acts as a receiver of the head part of the end stackers 220 and 230 so that no part of the stacker head need protrude from the board surface on that side, that is, that it may be substantially flush therewith. Of course, the ends of stackers 200 and 210 may also be seated in these holes for additional sizing arrangements. Thus any stacker 200, 210, 220, and 230 will fit into the enlarged diameter portion of any hole 300 on the main board 110 and side boards 100.

Figure 5B:
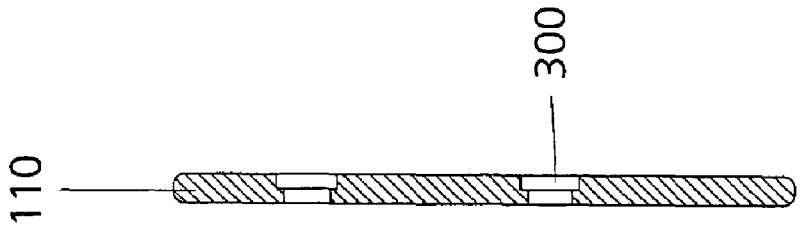
FIG. 5B is a cross-sectional view of the main board taken along the line B-B of FIG. 5A.
Figure 5A:
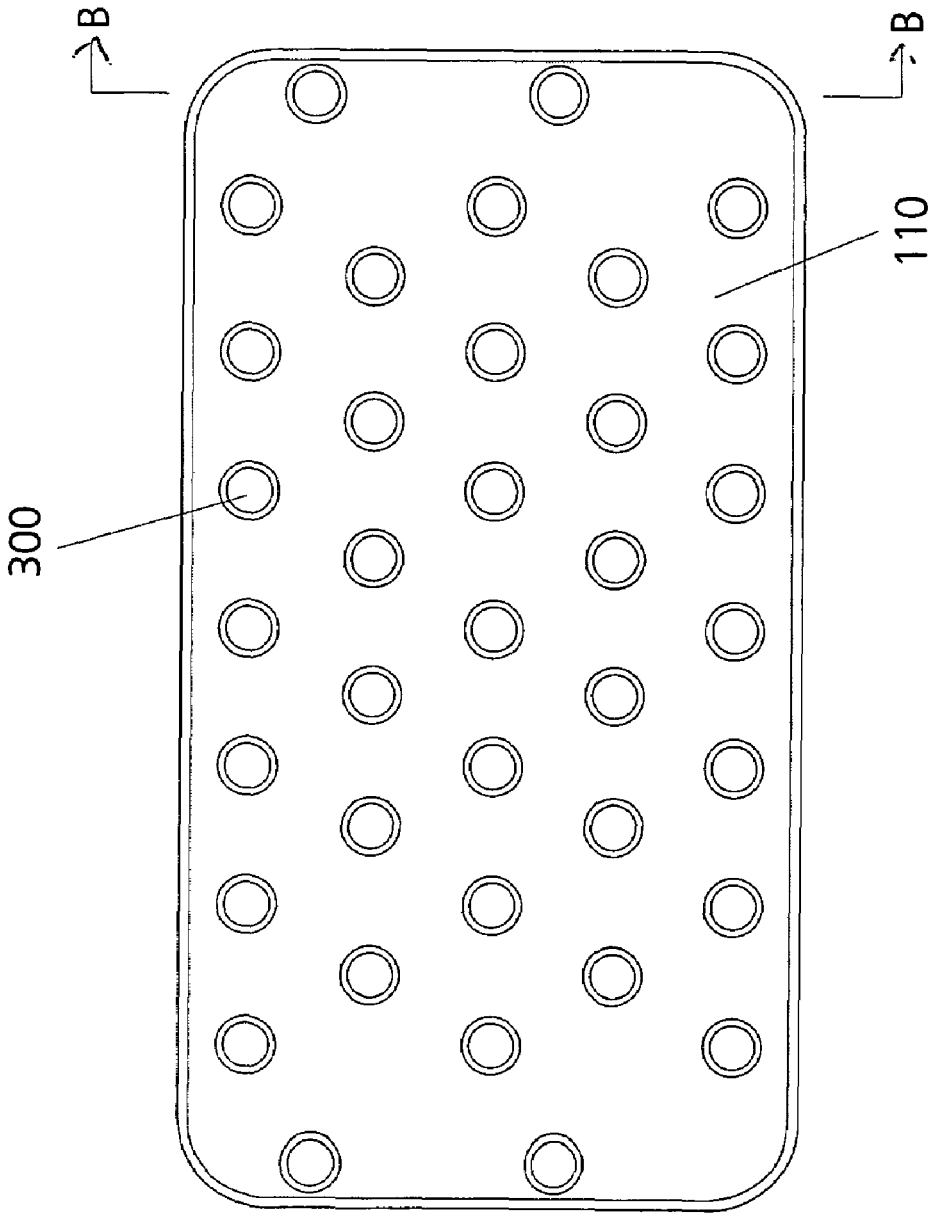
FIG. 5A is a top view of the main board of the adjustable support device of FIG. 1.

The main or center board 110 is illustrated by itself in FIGS. 5A and 5B. It has through-holes 300 to receive loosely the threaded male ends of stackers 200, 210, and bolt 220, and snugly rod portion of the bolt 220 and the sleeve portion of the nut 230, and other attachments. The holes 300 are all of the same dimensions and have two different diameters; a smaller diameter continuing through the board material, and a second and bigger diameter penetrating only partially through the material either on one or both sides of the board material. The partially penetrating hole receives the head part of a stacker 220 or 230 fully so that no part of the stacker head is left protruding from the board surface on that side; in other words, it is flush. When the nut or bolt is fully seated, the shoulder formed at the juncture of the corresponding stacker with its threaded head rests against the board to hold the stacker firmly in a rigidly upright position on the board. Any stacker 200, 210, 220, and 230 will fit into any hole 300 on the main board 110. Holes 300 in the board 110 not filled with stackers function to pass air operative to cool any object placed on the board; when a computer is the object placed on the board, the circulating air functions to help cool the computer.

Figure 6B:
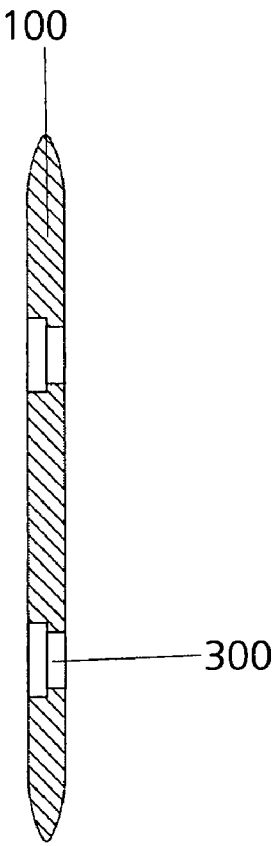
FIG. 6B is a cross-sectional view of the left side board taken along the line B-B of FIG. 5A.
Figure 6A:
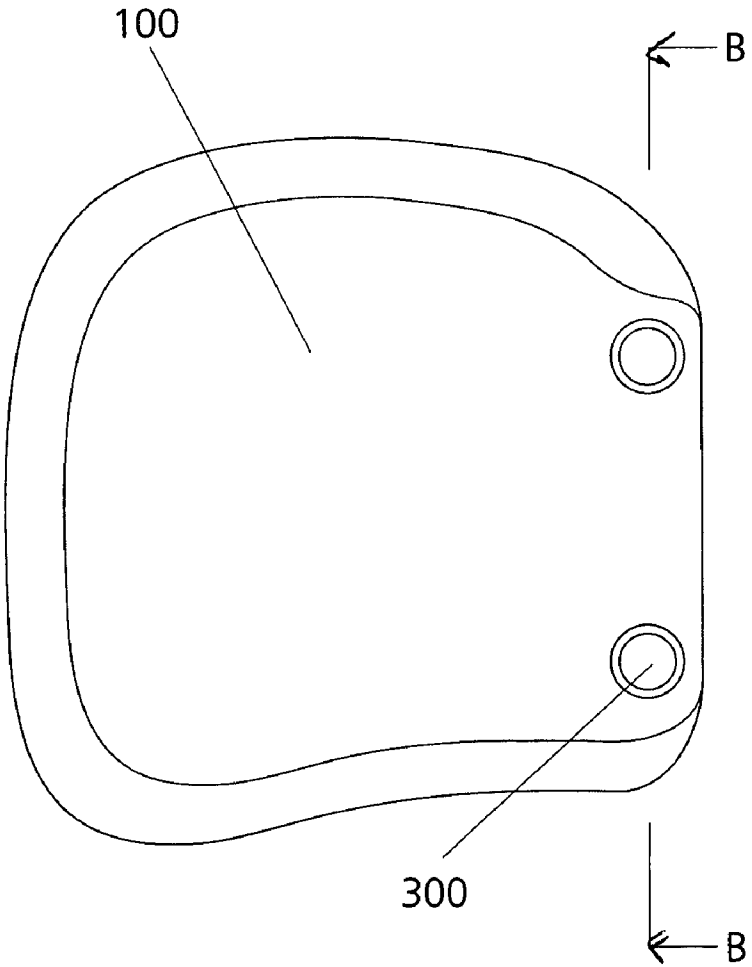
FIG. 6A is a top view of the left sideboard of the adjustable support device of FIG. 1.

The left side board 100 is illustrated by itself in FIGS. 6A and 6B. (The right side board is a mirror image of it. The sideboards 100 are to rest on the armrests of a chair to hold the main or center board 110 suspended between and on the armrests.) The left side board 100, of the same thickness as the main or center board 110, has like through-holes 300 to receive the threaded ends of stackers 200, 210, 220, and 230, and other attachments. The holes 300 are all of the same dimension and have two different diameters; a smaller diameter continuing through the board material, and a second, bigger diameter penetrating only partially through the material either on one or both sides of the board material. The partially penetrating hole receives the threaded head part of a stacker bolt 220 or nut 230 fully so that no part of the stacker head is left protruding from the board surface on that side; in other words, it is flush. The shoulder formed at the juncture of the stacker with its threaded head is seated on the board to help hold stacker firmly in a rigidly upright position on the board or another stacker. Any stacker 200, 210, 220, and 230 will fit into any hole 300 on the side board 100.

The bigger-diameter partially-penetrating hole may be omitted in the interests of economy and only the smaller diameter hole extended through the boards if flushness of the end stackers with the surfaces of the boards are not a concern, Details of a stacker 200 are shown in FIGS. 7A and 7B. Stacker 200 has a cylindrical body formed with a threaded hole 201 at one end, and with a threaded boss 202 at the other. The threads in the hole and on the boss are matching, so that several stackers may be connected to each other, end to end, to effect the desire spacing between the main or center board 110 and the side boards 100 of the device.

Details of a special stacker 210 are shown in FIGS. 8A and 8B. As mentioned earlier, the stackers 210 have tops of rubber 211 for resting an object softly and frictionally on the main or center board 110 (FIG. 1). The rubber top 211 may be secured to the top of the stacker 210 in any convenient manner, e.g. gluing or being formed with a threaded boss on its underside to be received in a threaded hole 201 in the top end of the stacker body. A threaded boss 212 is formed on the lower end of the stacker 210 to facilitate connection to other stackers or directly to the main board 110.

Figure 3:
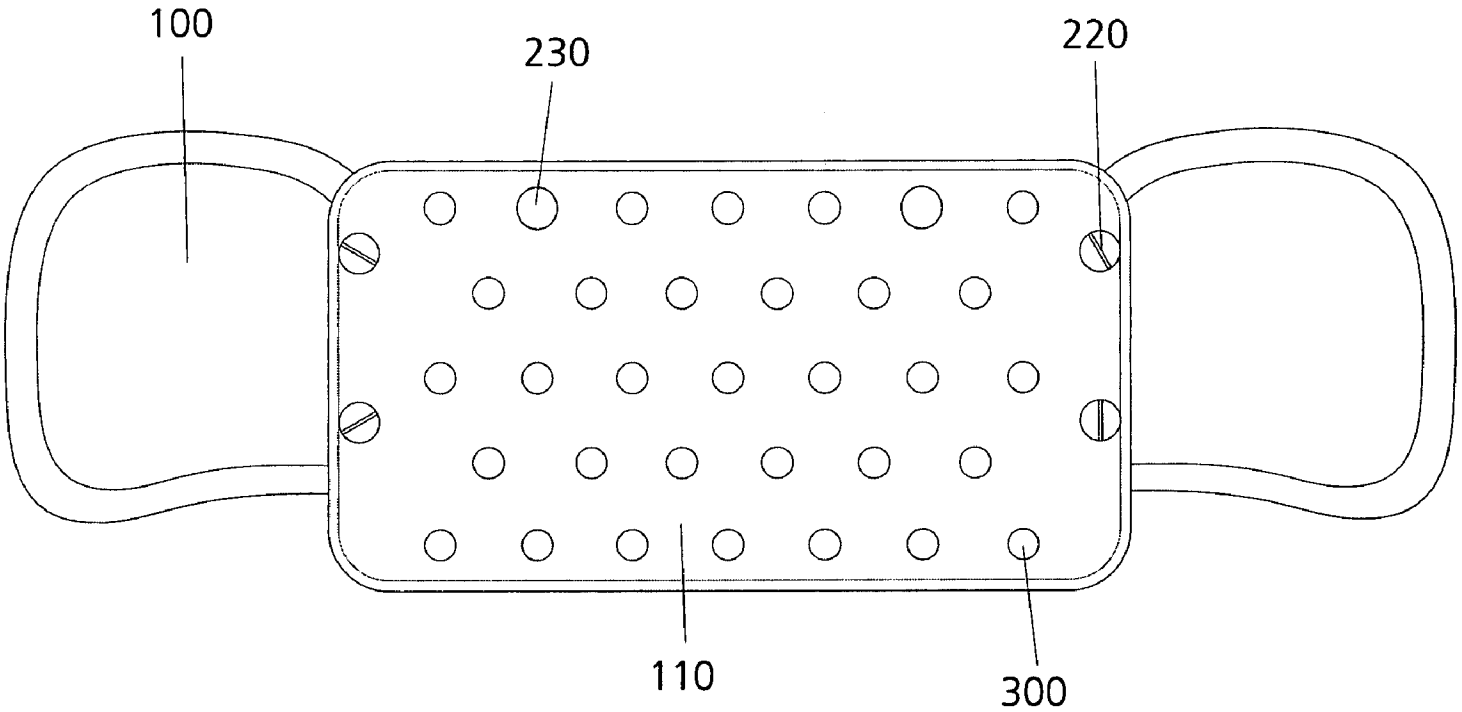
FIG. 3 is a bottom view of the adjustable support device of FIG. 1.
Figure 4:
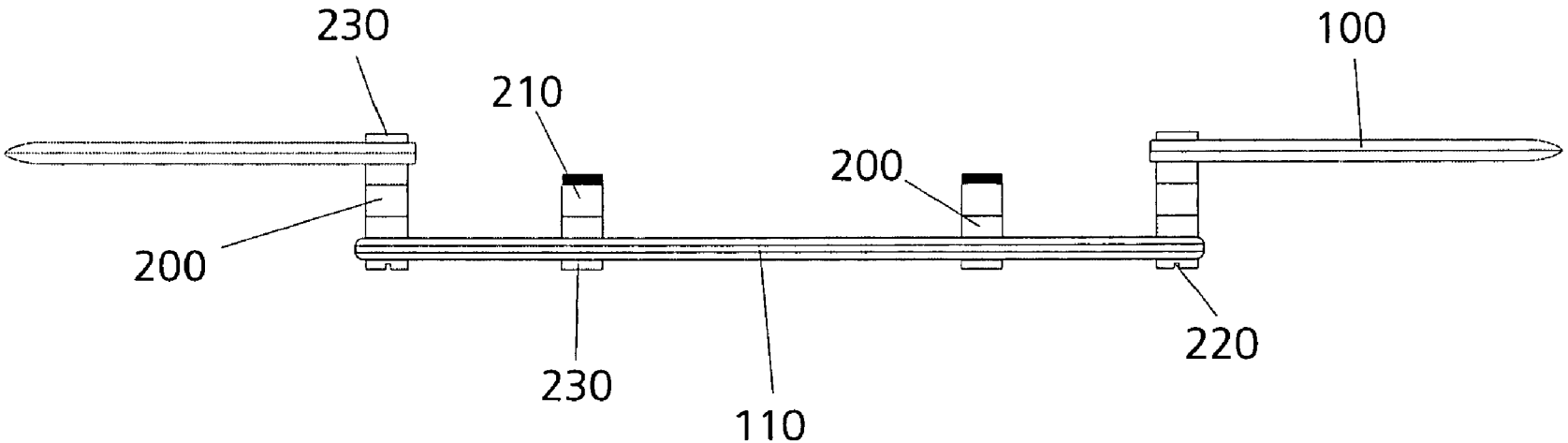
FIG. 4 is a front side view of the adjustable support device of FIG. 1.

The special or male end-stacker or bolt 220, for engaging the female end of a stacker 200 in one of through-holes 300, e.g. side board openings in FIGS. 1 and 3 and main board openings in FIGS. 3 and 4, to secure the stacker 200 rigidly in place on the board and provide flush surfaces, is shown in detail in FIGS. 9A and 9B. The stacker 220 below its head has its cylindrical body at its free end formed with a mating threaded boss of reduced diameter. The head at the other end of the cylindrical body has a slot 221 to facilitate use of a turning device such as a screw driver. The cylindrical body is snugly received in the small diameter portion of a through-hole 300

Figure 2:
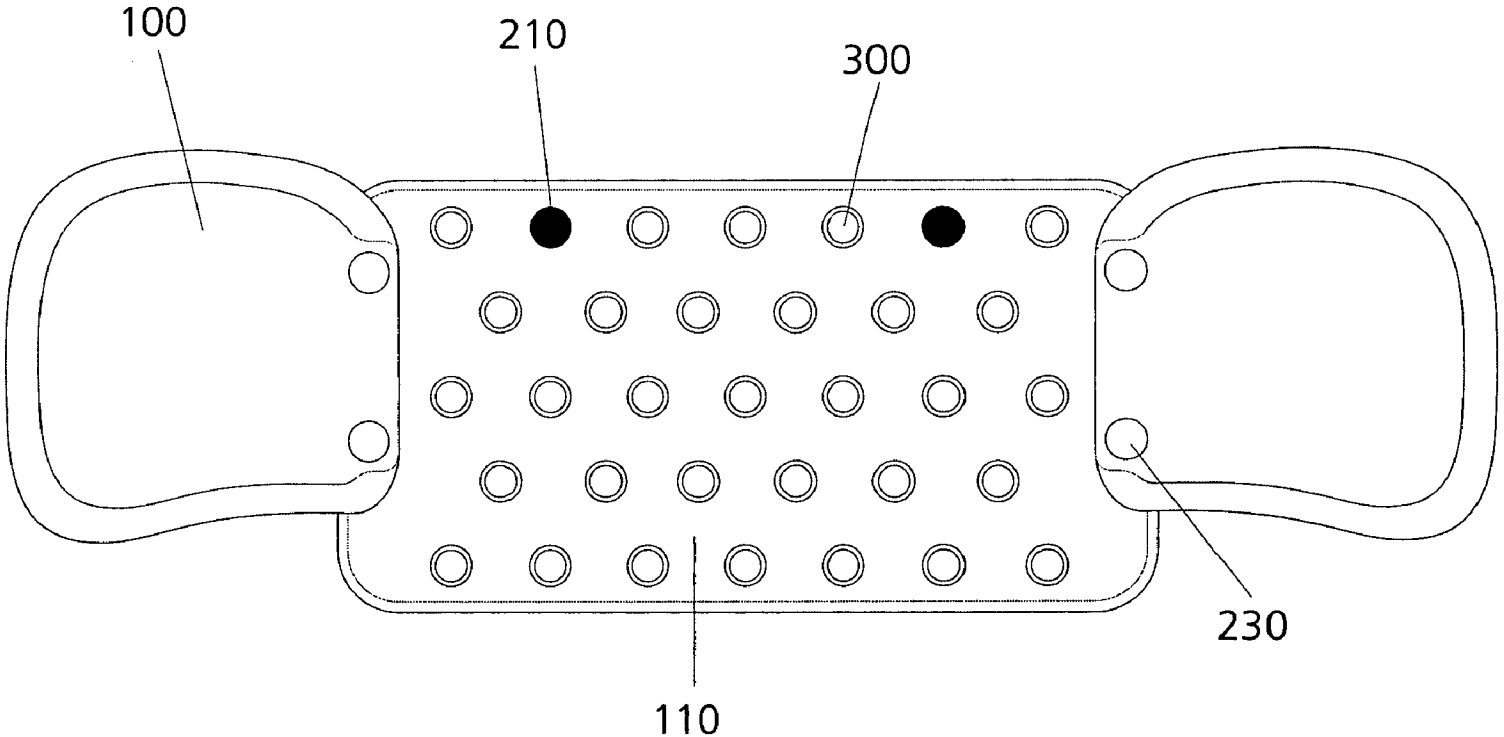
FIG. 2 is a top view of the adjustable support device of FIG. 1.

Another special or female end-stacker, 230, for engaging the threaded end 202 of stacker 200 on side board openings in FIGS. 2, and 4 and main board openings in FIGS. 3 and 4, is shown in detail in FIGS. 10A and 10B. The stacker 230 may have a cylindrical body formed as a sleeve with a threaded hole 231, and extends from a flat head. The threaded hole 231 facilitates connection to the threaded male ends of stackers 200, 210, and 220.

Figure 11:
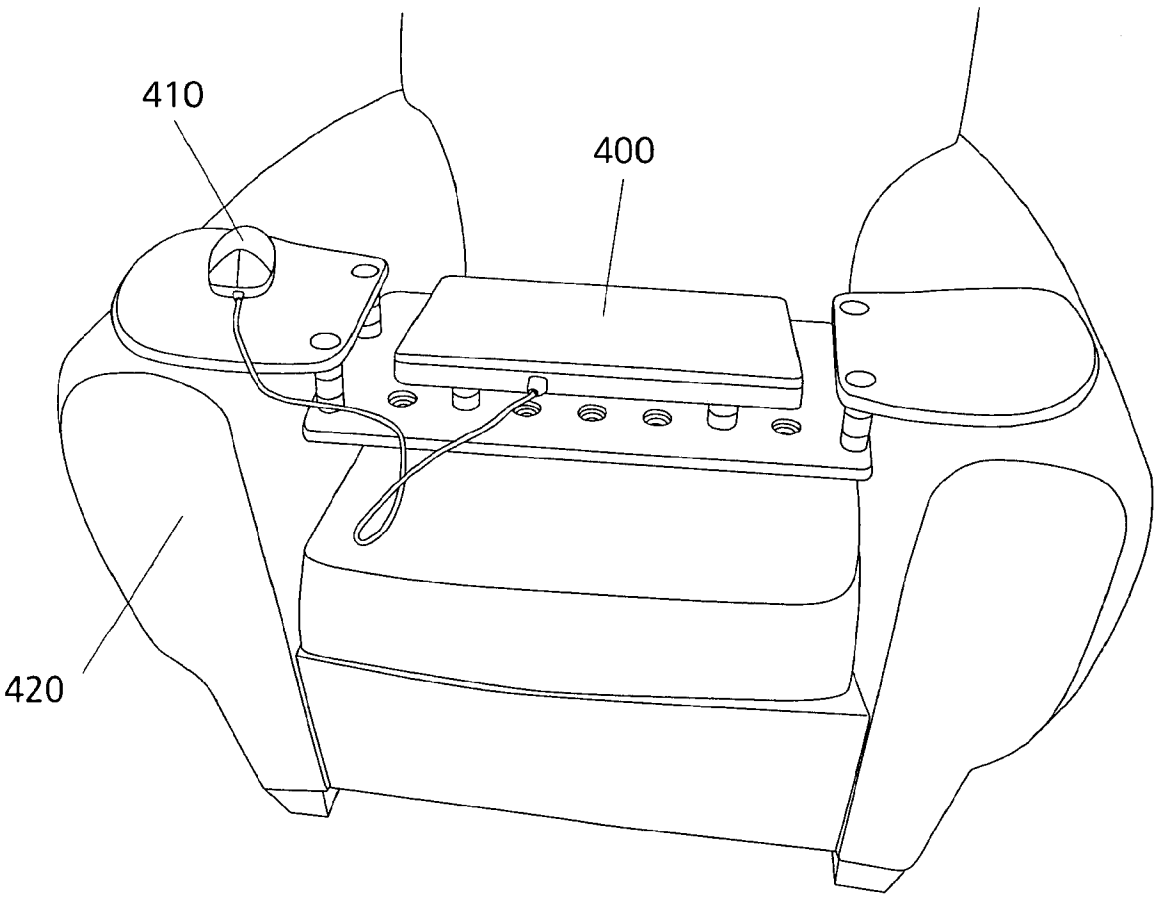
FIG. 11 is a perspective view of the adjustable support device of FIG. 1 seated on the arms of an easy chair.

As observed earlier, the device may weightlessly support an object in one's lap area. In FIG. 11, the side boards of the device rest on the arms of an easy chair 420, and the main or center board is spaced downwards therefrom to a depth convenient to a would-be user of the object thereon, in this case a computer 400. A computer mouse 410, electrically connected to the computer 400, rests on the right side board.

Figure 12:
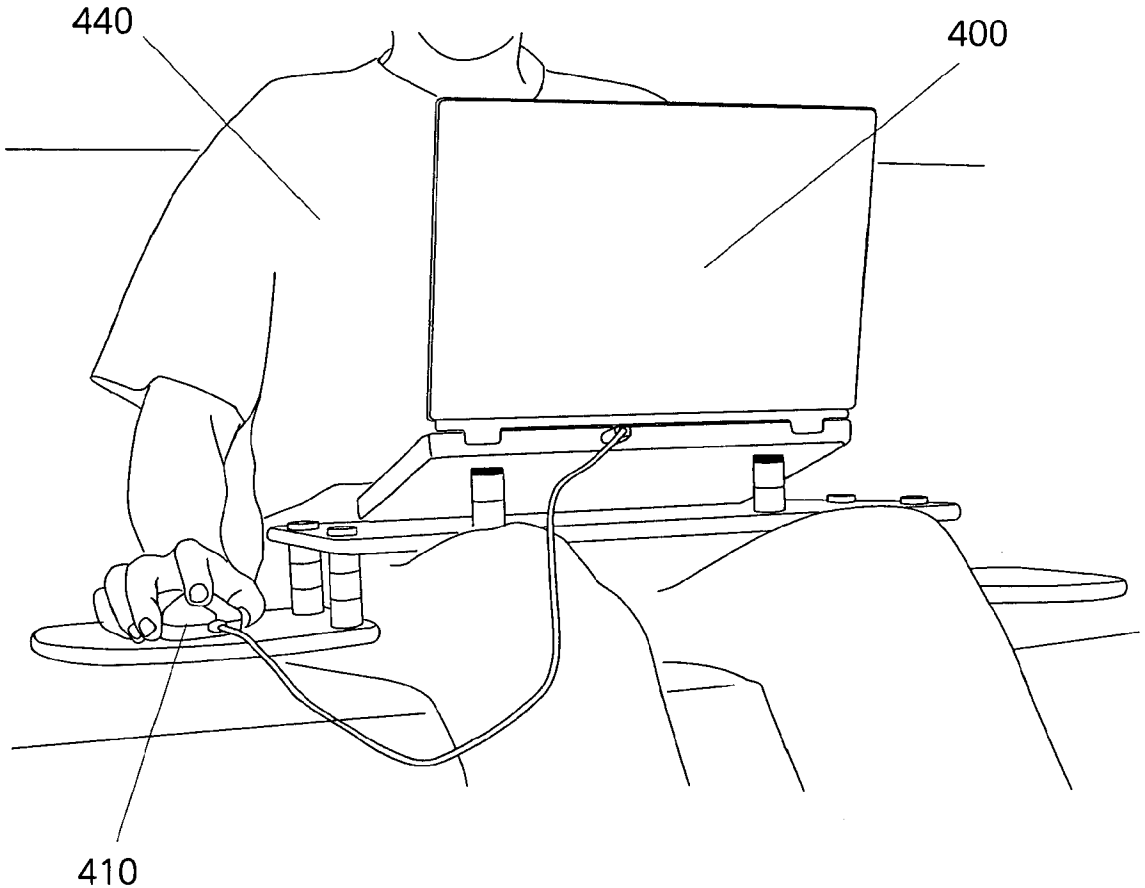
FIG. 12 is a perspective view of the support device of FIG. 1 adjusted for use on an extended couch and mounting a lap top computer on the main or center board and in the lap of a user and a computer mouse conveniently on a side board.

An alternative assemblage of the present invention is shown in FIG. 12. A user 440 is seated somewhere in the middle area of a couch. Side boards resting on the couch support a spaced elevated center or main board mounting tilted or canted on rubber topped stackers a computer 400. A computer mouse 410 rests on the right side board under the control of the user 440 right hand. Set of three stackers space the center board at a preferred height in his lap area above the user's legs. Two sets of a regular and a rubber topped stacker hold the rear end of the computer 400 in elevated position to provide the desired tilt or cant of the keyboard and screen to the user.

Figure 13:
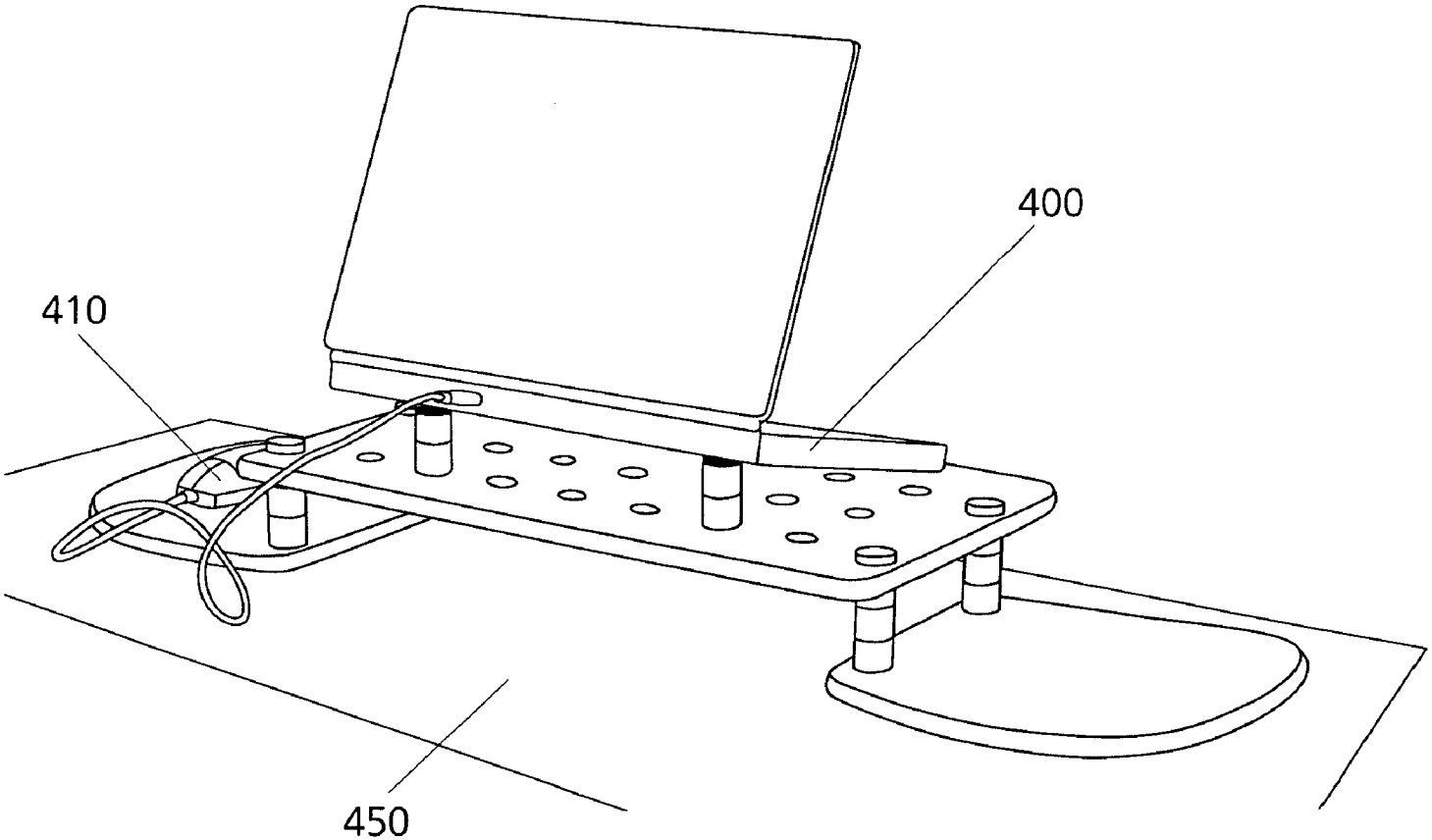
FIG. 13 is a view in perspective of the rear of the adjusted support device of FIG. 12 mounted on a flat surface such as a desk top.

The device as shown in FIG. 12, may also be used on a desk or table. As seen in FIG. 13, the side boards of the device rest on the desk surface 450. A computer mouse 410 rests on the right side board.

The main or center and the side boards 110 and 100 are formed with rounded edges for user safety. They are made out of white-translucent or clear acrylic, a plastic material with high stiffness, excellent chemical resistance, and good resistance to boiling water and physical impact. Acrylic surfaces are very smooth: accordingly a specially developed mouse pad such as one having a slightly uneve3n surface, should be used.

The stackers are made of strong, lightweight, machined aluminum.

No regular maintenance is needed since there are no moving parts. If connections come loose with use, they should be gently hand-tightened. Cleaning should be done with warm water and mild detergent. Neither abrasive cleaners nor pads nor paper towels should be used.

The device is shipped as a package of one main board, two side boards, eighteen regular stackers or raisers 200, two rubber top stackers or raisers 210, six flat top connectors or female end-stackers or raisers 220, four slot top connectors or male end-stackers 220, and a mouse pad. The regular sackers 200 are screwed together in groups of four along with an male end-stacker 220 and a female end-stacker 230. The other two end-stackers 200 are screwed to the two rubber topped stackers 210 and wrapped as a package.

A user assembles the device to suit his environment. He or she takes the four assemblies of raisers 200 and connectors 220 and 230 to connect the side boards 100 with the main or center board 110. The pieces are hand tightened lightly together. Then the two assemblies of raisers and rubber top raisers are attached to the back edge of the main board with the flat top connectors. The rubber tops will grip a laptop when it is placed thereon.

The main or center board and the side boards can be connected together in various ways. The main or center board can be depressed with respect to the side boards as in FIGS. 1-4 and 11; or elevated as in FIGS. 12 and 13; or mixed as for use at the end of a sofa. The boards can be separated greater or lesser distances by increasing or decreasing the number of regular stackers 200. The same is true for the tilt or cant of the computer keyboard and/or viewing screen.

It will be understood that, in addition to an adjustable support and cooling device for a portable computer, the device can be used to support any object, including but not limited to books, keyboards, dinner ware, monitors, etc.

It is intended that any other embodiments of the present invention that result from any changes in application or method of use or operation, method of manufacture, shape, size, connection method of stacker to stacker, connection method of stacker to main board or side board, or material which are not specified within the detailed written description or illustrations contained herein, whether or not are considered apparent or obvious to one skilled in the art, are within the scope of the present invention.

While preferred embodiments of the invention have been set forth and described, it will be apparent to those skilled in the art that other and different embodiments may be made using the principles of the invention. It is intended therefore to be limited only by the spirit or scope of the appended claims.

What is claimed is:

1. In a device for supporting an object weightlessly in a person's lap area, comprising a main board for mounting the object and having an end, a first and a second side board for resting on a surface and having an end, and stackers for rigidly securing the ends of the main board to the ends of the side boards in spaced horizontal relationship, wherein the ends of the three boards have through-holes and the stackers are rigidly secured to the respective boards via the through-holes.

2. A device for supporting an object weightlessly in a person's lap area according to claim 1, wherein the stackers are formed with a threaded boss of a reduced thickness compared to that of the stacker to form a shoulder on the stacker which engages the board when the threaded boss is inserted into one of the board through-holes, and a nut having a head of larger diameter than the through-hole fixed to a threaded sleeve of a diameter to be snugly received in the respective through-hole and mating with the respective stacker threaded boss to hold the shoulder of the stacker rigidly against the adjacent board surface.

3. A device for supporting an object weightlessly in a person's lap area according to claim 1, wherein the stackers are formed with a threaded opening, and bolts are having a head of larger diameter than a through-hole fixed to a body that fits snugly in a through-hole and bears a threaded boss of a diameter matingly received in the threaded opening of a stacker to hold the stacker rigidly against the adjacent board surface.

4. A device for supporting an object weightlessly in a person's lap area according to claim 1, wherein the main board is rigidly secured to the side boards in a depressed horizontal relationship to one of them and in an elevated relationship to the other of them.

5. A device for supporting an object weightlessly in a person's lap area according to claim 1, and other stackers rigidly secured to the main board for disposing an object thereon in a favorable position.

6. A device for supporting an object weightlessly in a person's lap area according to claim 5, wherein each stacker is formed at one end with a threaded boss of a reduced thickness compared to rest of the stacker to form a shoulder on the stacker that engages the adjacent surface of a board when the boss is inserted into a through-hole; and nuts each having a head of larger diameter than a through-hole fixed to a threaded sleeve of a diameter to be received in the through-hole and ending with a threaded portion of further reduced diameter for mating with a stacker threaded boss to hold the shoulder; and wherein each stacker is formed at an end with a threaded female opening, and bolts each having a head of larger diameter than the through-hole fixed to a rod portion of a diameter to be snugly received in the through-hole and terminating in a reduced diameter threaded boss for mating with a stacker threaded female opening to hold the end of the stacker firmly against the adjacent board surface.

7. A kit for assemblage into a device for supporting an object weightlessly in a person's lap area, comprising a main board for mounting the object and having an end, two side boards for resting on surfaces and each having an end, and stackers for rigidly securing the ends of the main board to the ends of the respective side board in spaced horizontal relationship.

8. A kit for assemblage into a device for supporting an object weightlessly in a person's lap area according to claim 7, wherein the ends of the two boards have through-holes and the stackers are rigidly secured to the respective boards via the through-holes.

9. A kit for assemblage into a device for supporting an object weightlessly in a person's lap area according to claim 8, wherein each stacker is formed at an end with a threaded female opening, and bolts each having a head of larger diameter than the through-hole fixed to a rod portion of a diameter to be snugly received in the through-hole and terminating in a reduced diameter threaded boss for mating with a stacker threaded female opening to hold the end of the stacker firmly against the adjacent board surface.

10. A kit for assemblage into a device for supporting an object weightlessly in a person's lap area according to claim 8, wherein each stacker is formed at one end with a threaded boss of a reduced thickness compared to rest of the stacker to form a shoulder on the stacker that engages the adjacent surface of a board when the boss is inserted into a through-hole, and nuts each having a head of larger diameter than the through-hole fixed to a threaded sleeve of a diameter to be received snugly in the through-hole and mating with a stacker threaded boss to hold the shoulder of the stacker firmly against the adjacent board surface.

11. A kit for assemblage into a device for supporting an object weightlessly in a person's lap area according to claim 10, wherein each stacker is formed at an end other than the one end with a threaded female opening, and bolts each having a head of larger diameter than the through-hole fixed to a rod portion of a diameter to be snugly received in a through-hole and terminating in a reduced diameter threaded boss for mating with a stacker threaded female opening to hold the end of the stacker firmly against the adjacent board surface.

12. A kit for assemblage into a device for supporting an object weightlessly in a person's lap area according to claim 10, wherein each stacker is formed at another end with a threaded female opening, and bolts each having a head of larger diameter than a through-hole fixed to a rod portion of a diameter to be snugly received in a through-hole and terminating in a reduced diameter threaded boss for mating with a stacker threaded female opening to hold the end of the stacker firmly against the adjacent board surface.

13. A kit for assemblage into a device for supporting an object weightlessly in a person's lap area according to claim 7, and extra stackers for rigid interconnection with other stackers to increase the spacing between the boards.

* * * * *